United States Patent [19]

Mills

[11] 4,281,512

[45] Aug. 4, 1981

[54] APPARATUS FOR REDUCING NON-GASEOUS POLLUTANTS

[75] Inventor: King L. Mills, Bartlesville, Okla.

[73] Assignee: Phillips Petroleum Company, Bartlesville, Okla.

[21] Appl. No.: 89,419

[22] Filed: Oct. 30, 1979

[51] Int. Cl.[3] ..... F01H 3/02

[52] U.S. Cl. ..... 60/311; 55/213; 55/283; 55/313; 55/523; 55/466; 55/350

[58] Field of Search ..... 55/96, 97, 213, 273, 55/283, 302, 312–314, DIG. 30, 466, 350, DIG. 10, 523; 60/311, 291, 296, 299, 301; 422/178, 223, 110–112

[56] References Cited

U.S. PATENT DOCUMENTS

| | | | |
|---|---|---|---|
| 1,493,110 | 5/1924 | Diehl | 55/303 |
| 3,211,534 | 10/1965 | Ridgway | 60/296 |
| 3,248,183 | 4/1966 | Powell | 55/523 |
| 3,408,794 | 11/1968 | Stoddard | 55/DIG. 10 |
| 3,762,143 | 10/1973 | Stewart | 55/283 |
| 3,937,015 | 4/1974 | Akado et al. | 60/311 |
| 3,988,891 | 11/1974 | Hoyler | 60/288 |
| 4,167,852 | 9/1979 | Ludecke | 60/296 |

FOREIGN PATENT DOCUMENTS

| | | | |
|---|---|---|---|
| 2519609 | 11/1976 | Fed. Rep. of Germany | 60/311 |
| 2756570 | 9/1978 | Fed. Rep. of Germany | 60/299 |
| 778537 | 7/1957 | United Kingdom | 55/97 |

*Primary Examiner*—Bernard Nozick

[57] ABSTRACT

An apparatus for removing non-gaseous pollutants from exhaust and flue gases produced by the burning of a fuel in which the exhaust or flue gases are intervally passed through one of a first filter means and a second filter means, a combustion supporting gas is supplied to the other of the first filter means and the second filter means during at least a part of the interval during which the exhaust or flue gas is passing through the one of the first filter means and the second filter means and non-gaseous pollutants, which have collected on the other of the first filter means and the second filter means are burned from the other filter means in the presence of the combustion supporting gas during the at least part of the interval during which the exhaust or flue gas is passing through the one of the filter means.

8 Claims, 2 Drawing Figures

APPARATUS FOR REDUCING NON-GASEOUS POLLUTANTS

BACKGROUND OF THE INVENTION

The present invention relates to an apparatus for burning fuels. More specifically the present invention relates to an apparatus for reducing non-gaseous pollutants in the burning of fuels. Still more specifically, the present invention relates to an apparatus for reducing non-gaseous pollutants in the burning of low volatility fuels.

In the burning of heavy hydrocarbon fuels, having volatilities lower than that of automotive gasoline, a serious and continuing problem is the relatively high content of non-gaseous pollutants, such as carbon, unburned fuel and partially burned fuel, in the flue and exhaust gases. This of course has led the U.S. Environmental Protection Agency (EPA) to set standards limiting the quantity of particulate materials which may be discharged into the atmosphere. For example, for stationary sources, such as industrial process furnaces and heaters and boilers utilized in electrical generation, the 1974 maximum limit of particulate matter discharge was 0.1 lb/MM BTU of energy produced by a given furnace, heater or boiler. Presently, this limit is 0.03 lb/MM BTU and presumably this limit will be lowered in the future. While there are no present regulations limiting particulate emissions from spark-ignition and compression-ignition engines, proposed standards, scheduled to be effective in 1981 or 1982, limit emissions to 0.6 gram/mile and by 1983 or thereafter to 0.2 gram/mile traveled by the vehicle. Current shortages of petroleum make the problems of the burner or engine manufacturer as well as the fuel manufacturer even more difficult. From the fuel manufacturer's standpoint, it has become necessary to utilize less desirable petroleum sources to produce fuel and to look to other fossil fuel sources, such as coal, shale oil, coal oils and the like to supplement the crude oils presently available. From the equipment manufacturer's standpoint, the standards for stationary source equipment can be met by utilizing scrubbers, precipitators, cyclone separators and the like to clean up the flue gases. However, such equipment cannot be utilized, as a practical matter, in the so-called non-stationary burners, such as compression-ignition and spark-ignition engines. In addition, petroleum shortages have renewed interest in the utilization of the compression-ignition or diesel engine for automotive use, since such engines are considered more economical and are capable of utilizing heavier or less volatile fuels than the ordinary spark-ignition engine. However, as indicated previously such heavier fuels and fuels from non-petroleum sources are more prone to produce exhaust gases containing large amounts of unburned fuels, partially burned fuels, carbon particles and other particulate material.

Since the more exotic cleanup equipment utilized to clean up the flue gases from stationary sources cannot be utilized in the socalled non-stationary engines, it has recently been proposed that filters be utilized on the exhaust from a diesel engine or the like for removing the non-gaseous pollutants from the exhaust. However, the very nature of these non-gaseous pollutants, particularly from low volatility oils, create serious problems in the utilization of conventional filter systems. For example, carbon particles and the like may be as small as $0.1\mu$ and accordingly the filter must be designed to have a relatively low permeability so as to screen out these small particles. In addition, the non-gaseous pollutants are often made up of as much as 30 percent of heavy oils. Accordingly, in addition to requiring a low permeability filter there is a tendency for the filter to readily plug due both to the low permeability as well as the nature of the material being filtered out. Replacement of the filter at quite frequent intervals would appear to be necessary. However, this is not a practical solution because of the fact that the volume of such non-gaseous pollutants contained in emissions from low volatility oils and fuels from non-petroleum sources may be as high as 1 to 3 gallons/1000 miles traveled by the vehicle or even higher.

It is therefore an object of the present invention to overcome the above mentioned problems of the prior art.

Another object of the present invention is to provide an improved method and apparatus for the reduction of non-gaseous pollutants in the burning of a fuel.

A further object of the present invention is to provide an improved method and apparatus for the reduction of non-gaseous pollutants in the burning of a fuel having a low volatility.

Still another object of the present invention is to provide an improved method and apparatus for the reduction of non-gaseous pollutants in the burning of fuels from non-petroleum sources.

Another and further object of the present invention is to provide an improved method and apparatus for filtering out non-gaseous pollutants from exhaust gases in the burning of a fuel.

A still further object of the present invention is to provide an improved method and apparatus for filtering non-gaseous pollutants from flue and exhaust gases produced in the burning of a fuel.

A further object of the present invention is to provide an improved method and apparatus for filtering non-gaseous pollutants from exhaust gases of a compression-ignition engine.

SUMMARY OF THE INVENTION

A method and apparatus for removing non-gaseous pollutants from exhaust and flue gases produced by the burning of a fuel in which the exhaust or flue gases are intervally passed through one of a first filter means and a second filter means, a combustion supporting gas is supplied to the other of the first filter means and the second filter means during at least a part of the interval during which the exhaust or flue gas is passing through the one of the first filter means and the second filter means and non-gaseous pollutants, which have collected on the other of the first filter means and the second filter means are burned from the other filter means in the presence of the combustion supporting gas during the at least part of the interval during which the exhaust or flue gas is passing through the one of the filter means.

DESCRIPTION OF THE PREFERRED EMBODIMENTS

While the burning of high volatility automotive gasoline, derived from conventional petroleum or crude oil, does not present problems of high production of non-gaseous pollutants, automotive gasolines derived from sources other than conventional petroleum, such as heavier petroleum or crude oil, shale derived oils, coal derived oils, etc. do create these problems because of the different character of the hydrocarbons contained in the latter types of oils. As previously indicated, heavier fuels do present a problem even though derived from presently available crude oils. Specifically, aviation gasolines or jet fuels generally falling within the range of kerosenes, or more specifically, having an ASTM 10 percent distillation point of about 75° C., a 90 percent distillation point of about 135° C. and an end point of about 170° C., do generate significant quantities of non-gaseous pollutants, particularly when the engine is operating at relatively low efficiencies, i.e., during acceleration and deceleration. Still greater problems are contributed by distillate fuels having flash points above about 38° C. Falling within this category, and of particular significance in accordance with the present invention, are diesel fuels. While diesel fuels are generally considered a No. 2 distillate fuel oil, having a minimum flash point of about 38° C. and distillation points above that of a No. 1 distillate fuel oil, diesel fuels can cover the entire gamut of distillate fuel oils having a flash point anywhere from about 38° C. to as high as 88° C., depending to a great extent upon atmospheric conditions of use. Consequently, the present invention is directed primarily to the reduction of non-gaseous pollutants in the burning of any fuel having a volatility below that of automotive gasoline, particularly distillate fuel oils and still more particularly diesel fuels. While this problem is particularly significant with respect to the burning of fuels in compression-ignition or diesel type engines, the problem is not confined to such engines but there are many instances in which a so-called stationary engine, for one reason or another, cannot utilize precipitators, cyclone separators and the like to remove nongaseous pollutants from flue gases. Accordingly, the present invention is directed to the removal of non-gaseous pollutants from exhaust and flue gases from the burning of any type of fuel having a tendency to produce significant quantities of such non-gaseous pollutants and to the burning of such fuels in any type of burner of the so-called stationary burner type or the nonstationary engine type.

As previously indicated the present invention is directed to a method and apparatus for filtering non-gaseous pollutants from exhaust and flue gases.

The nature of the present invention will be evident from the following description when read in conjunction with the drawings.

Figure 1:
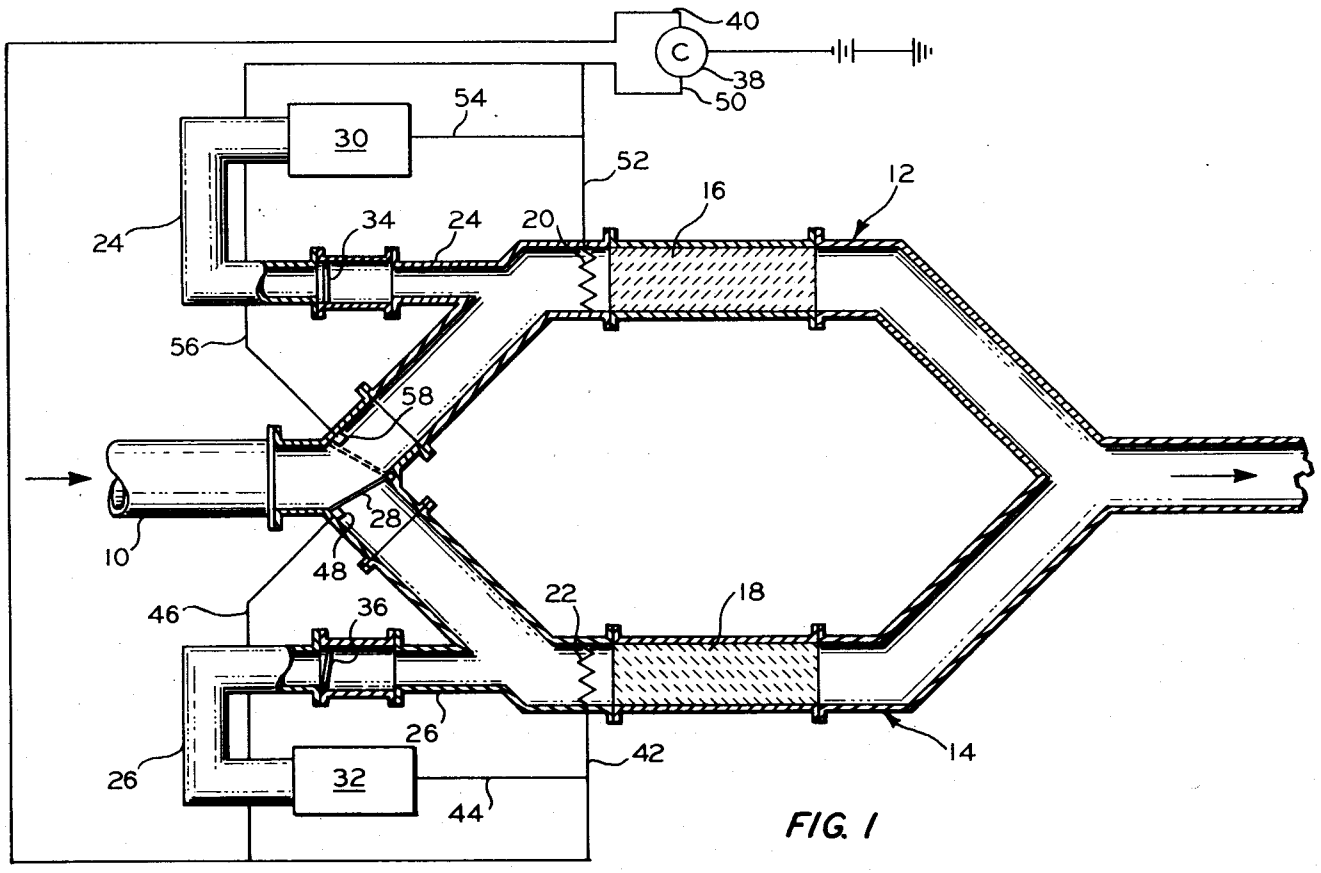
FIG. 1 shows apparatus, partially in section, for use in accordance with one embodiment of the present invention.

In accordance with FIG. 1, exhaust or flue line from a burner source is indicated by the numeral 10. FIG. 1 shows one embodiment of a filtering system in accordance with the present invention is connected to line 10. The filtering system includes two branch lines 12 and 14, respectively. Mounted in branch line 12 is a filter 16 and a like filter 18 is mounted in branch line 14. Filters 16 and 18 are adapted to withstand temperatures as high as at least about 1500° to 2000° F., for reasons which will be apparent hereinafter. Consequently, filters 16 and 18 are ceramic filters or filters of a high alloy steel or the like. Filters 16 and 18 should also have a sufficiently low permeability to remove particles as small as 0.1$\mu$. It has been discovered in accordance with the present invention that efficient filtering may be effected by first utilizing either filter 16 or 18 on a filtering cycle while the other filter is being regenerated. Such regeneration is carried out, in accordance with the present invention, by burning-off accumulated non-gaseous pollutants which have accumulated in the filter. This is accomplished by igniting such non-gaseous pollutants by means of hot wire ignition means 20 and 22 adjacent filters 16 and 18, respectively. Ignition means 20 and 22 are preferably hot wire tye ignitors and may be any appropriate ignition means such as a single high resistance wire, a spiral coil of high resistance wire or a plurality of parallel spaced high resistance ignition wires. In any event, the primary purpose of the ignition wire is to initiate burning of the carbon and unburned and partially burned fuels which have accumulated in the filter. The ignition means 20 and 22 may be adjacent the upstream ends of the filters or embedded in the filters in various ways. Air is supplied to filters 16 and 18, for the purpose of supporting combustion of the non-gaseous pollutants contained in the filters, through air lines 24 and 26, respectively. As shown in FIG. 1 branch line 14 is closed, for purposes of regeneration of the filter or burning off the non-gaseous pollutants, by means of a simple flapper valve 28 while branch line 12 is open for filtering exhaust gas passing through exhaust line 10. Any appropriate valve means to close one of branch lines 12 and 14 while opening the other can of course be utilized. Compressed air is supplied to air lines 24 and 26 from compressors 30 and 32, respectively. In the arrangement shown in FIG. 1, where two compressors are utilized, back flow of exhaust gas to the compressors is prevented by means of simple check valves 34 and 36 in air lines 24 and 26, respectively. The switching of the filters in branch lines 12 and 14 from the filtering cycle to the regeneration or burn-off cycle can be accomplished by any suitable means. Obviously, such switching could be done by a simple hand switch. However, this is not really a practical means of accomplishing the desired result. Consequently, the filter system is preferably provided with a control means 38. Control means 38 is adapted to supply power to the elements associated with branch line 14 through line 40, to ignition means 22 through line 42, to compressor 32 through line 44 and to valve 28 through line 46. As shown in FIG. 1, the means for operating valve 28 is a simple magnet 48. Any particular electrically operated valve may be employed to close a normally open valve or valves or open a normally closed valve or valves. Similarly, power is supplied to the elements associated with branch line 12 through line 50, to ignition means 20 through line 52, to compressor 30 through line 54 and to valve 28 through line 56. For the operation of valve 28, power is supplied to magnet means 58. Control means 38 may be any appropriate control means adapted to switch filters 16 and 18 from the filtering to the regeneration or burn-off cycles at regular or irregular intervals. For example, a simple timer switch could be utilized to switch from the filtering to the regeneration or burn-off cycle at regular intervals. Control means 38 could also be connected to the odometer of a vehicle utilizing the filter system, in order to initiate regeneration on an "as necessary" basis. For example, control means 38 could be adapted to switch filters to the regeneration cycle every thousand miles or the like of vehicle travel.

Figure 2:
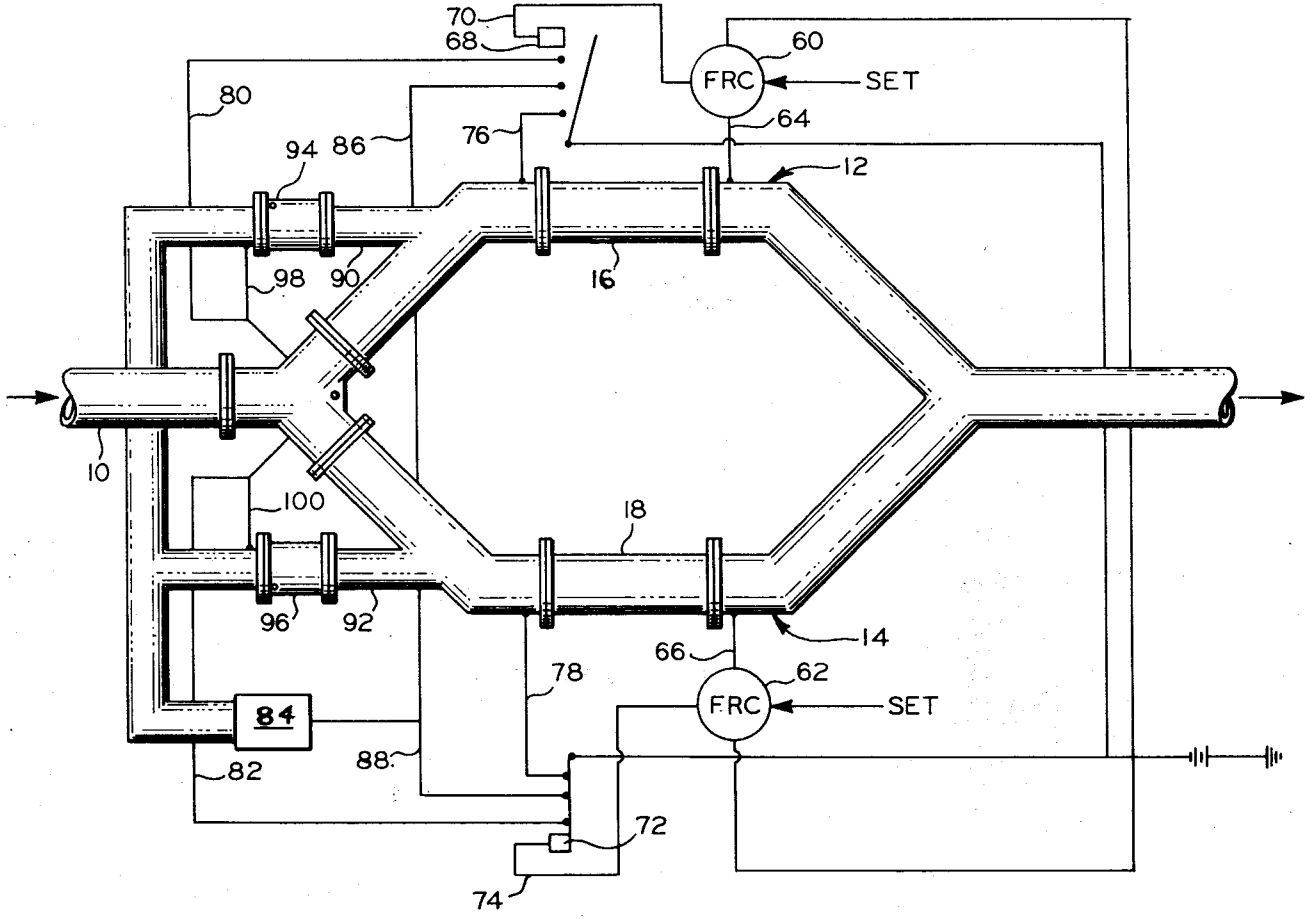
FIG. 2 shows apparatus for use in another embodiment of the present invention.

FIG. 2 of the drawings shows an alternative control system which can be utilized to switch from the filtering to the regeneration or burn-off cycles automatically at irregular intervals. For example, a flow recorder-controller means 60 could be appropriately connected to branch line 12 to measure the rate of flow of exhaust gas at the downstream end of filter 16. Thus, when the filter 16 became plugged to the extent that the rate of flow of exhaust gas through filter 16 dropped below a predetermined value, flow recorder controller 60 would be operative to initiate the regeneration cycle. Likewise, a similar flow recorder-controller 62 could be connected at the downstream end of filter 18 in branch line 14. Obviously, other appropriate measuring and control devices could be utilized. For example, pressure recorder-controller systems could be substituted for flow recorder-controllers 60 and 62. In this instance, when the pressure downstream of one of the filters 16 or 18 dropped below a predetermined value, the pressure recorder controller system would be actuated to switch the particular filter in question to the regeneration or burn-off cycle. Obviously, if the pressure or flow measured downstream of one of the filters 16 or 18 drops below a predetermined value, this indicates that that particular filter is at least partially plugged with non-gaseous pollutants and is ready to be regenerated. A signal from the measuring means, located downstream of the filters 16 and 18, is supplied to flow recorder-controller 60 through line 64 and to flow recorder-controller 62 through line 66. Flow recorder-controller 60 sends a signal to solenoid switch 68 to close the switch. Similarly, power from flow recorder-controller 62 is supplied to solenoid switch 72 through line 74 which, in turn, closes this switch. When solenoid switches 68 and 72, respectively, are closed, power is applied to the ignition means in branch line 12 through line 76 and to the ignition means in branch line 14 through line 78. Power is also supplied for the operation of valve 28 (as shown in FIG. 1) through lines 80 and 82 through switches 68 and 72, respectively. In the embodiment shown in FIG. 2 a single air compressor 84 is utilized rather than the two air compressors as shown in FIG. 1. In this instance, power is supplied to the air compressor 84 through line 86 from solenoid switch 68 and through line 88 from solenoid switch 72. Since a single compressor 84 is utilized, air is supplied to branch line 12 through air line 90 and to branch line 14 through air line 92 and electrically-operated valves 94 and 96 are mounted in lines 90 and 92, respectively. Obviously conventional check valves cannot be utilized when a single air compressor is utilized to supply air through lines 90 and 92, respectively. Valves 94 and 96 are supplied with power from solenoid switch 68 and solenoid switch 72 through lines 98 and 100, respectively, in order to open normally-closed switches.

While specific items of equipment, materials of construction and modes of operation have been referred to herein, it is to be understood that such references are for illustrative purposes and are not to be considered limiting, since one skilled in the art can readily conceive of alternatives therefor.

I claim:

1. Apparatus for removing combustible, non-gaseous pollutants from gaseous combustion products containing the same, comprising:

(a) transmission line means adapted to receive said gaseous combustion products from a source of said gaseous combustion products and pass the same through said transmission line means;

(b) first branch line means and second branch line means in communication with said transmission line means and adapted to receive said gaseous combustion products from said transmission line means and pass the same through said first and second branch line means, each of said first and second branch line means, including:

(1) filter means adapted to filter at least a significant amount of said combustible, non-gaseous pollutants from said gaseous combustion products;

(2) normally-closed, combustion-supporting gas supply line means in communication with said branch line means and adapted to supply combustion supporting gas to said filter means;

(3) ignition means adjacent said filter means and adapted to ignite and burn combustible, non-gaseous pollutants collected in said filter means; and (4) sensing means in said branch line means downstream of said filter means and adapted to sense one of the pressure or the flow rate of gaseous combustion products passing through said branch line means;

(c) valve means adapted to simultaneously close one of said first and second branch line means and prevent the passage of said gaseous combustion products therethrough and open the other of said first and second branch line means and pass said gaseous combustion products therethrough; and (d) control means operatively connecting said sensing means in said first and second branch line means to said combustion supporting gas supply line means in communication with said first and second branch line means, said ignition means in said first and second branch line means and said valve means and adapted to close one of said first and second branch line means, open said combustion supporting gas supply line means in communication with said closed branch line means to supply combustion supporting gas thereto, actuate said ignition means in said closed branch line means to ignite and burn combustible, non-gaseous pollutants collected in the filter means in said closed branch line means and open the other of said first and second branch line means and pass gaseous combustion products therethrough, when the pressure or flow rate, respectively, sensed by said sensing means in the one of said first and second branch line means through which gaseous combustion products reaches a predetermined value.

2. Apparatus in accordance with claim 1 wherein the source of gaseous combustion products is a compression-ignition engine.

3. Apparatus in accordance with claim 1 wherein the sensing means for sensing the pressure or flow rate of the gaseous combustion products is a means for sensing the pressure thereof and the control means operates as specified in claim 1 when the pressure in the one of the first and second branch line means through which the gaseous combustion products are passing drops below a predetermined value.

4. Apparatus in accordance with claim 1 wherein the sensing means for sensing the pressure or the flow rate of the gaseous combustion products is a means for sensing flow rate thereof and the control means operates as specified in claim 1 when the flow rate of said gaseous combustion products in the one of said first and second branch line means through which the gaseous combustion products are passing drops below a predetermined value.

5. Apparatus in accordance with claim 1 wherein the filter means is adapted to remove combustible, non-gaseous pollutants having a particle size below about $1\mu$ from the gaseous combustion products.

6. Apparatus in accordance with claim 1 wherein the filter means is adapted to withstand temperatures of at least about 1500° F. to about 2000° F.

7. Apparatus in accordance with claim 1 wherein the filter means is a ceramic filter means.

8. Apparatus in accordance with claim 1 wherein the ignition means is a hot-wire type ignition means.

* * * * *